US006880224B2

(12) United States Patent
Colarusso et al.

(10) Patent No.: US 6,880,224 B2
(45) Date of Patent: Apr. 19, 2005

(54) DEFORMED REINFORCING BAR SPLICE AND METHOD

(75) Inventors: Louis Colarusso, Macedonia, OH (US); Mark Victor Samas, Willoughby Hills, OH (US)

(73) Assignee: Erico International Corporation, Solon, OH (US)

( * ) Notice: Subject to any disclaimer, the term of this patent is extended or adjusted under 35 U.S.C. 154(b) by 0 days.

(21) Appl. No.: 10/603,367

(22) Filed: Jun. 25, 2003

(65) Prior Publication Data

US 2004/0261244 A1 Dec. 30, 2004

(51) Int. Cl.[7] ..... B21D 39/00

(52) U.S. Cl. ..... 29/456; 52/726.1; 403/305; 403/307

(58) Field of Search ..... 29/456, 525.11, 29/DIG. 18, DIG. 41; 52/726.1; 72/89, 103; 403/305, 307

(56) References Cited

U.S. PATENT DOCUMENTS

| | | | | | |
|---|---|---|---|---|---|
| 2,666,348 | A | * | 1/1954 | Trishman | 72/103 |
| 3,415,552 | A | * | 12/1968 | Howlett | 52/726.1 |
| 3,835,690 | A | * | 9/1974 | Leonhardt et al. | 72/415 |
| 3,850,535 | A | * | 11/1974 | Howlett et al. | 403/305 |
| 3,858,846 | A | | 1/1975 | Schmid | |
| RE31,084 | E | * | 11/1982 | Birks | 72/416 |
| 4,584,247 | A | * | 4/1986 | Mulholland | 428/592 |
| 4,619,096 | A | | 10/1986 | Lancelot, III | |
| 4,752,159 | A | * | 6/1988 | Howlett | 408/14 |
| 4,870,848 | A | * | 10/1989 | Kies et al. | 72/89 |
| 5,054,146 | A | * | 10/1991 | Wiesenfeld et al. | 470/16 |
| 5,131,204 | A | * | 7/1992 | Hiendl | 52/726.1 |
| 5,152,118 | A | * | 10/1992 | Lancelot | 52/726.1 |
| 5,158,527 | A | | 10/1992 | Bernard | |
| 5,411,347 | A | * | 5/1995 | Bowmer et al. | 403/305 |
| 5,660,594 | A | | 8/1997 | Viljakainen | |
| 5,776,001 | A | | 7/1998 | Carter | |
| 6,735,994 | B1 | * | 5/2004 | Buhler et al. | 72/20.1 |

FOREIGN PATENT DOCUMENTS

| | | |
|---|---|---|
| CN | 96215047.9 | 1/1998 |
| CN | 97107856.4 | 7/1999 |
| EP | 0947642 | 10/1999 |
| EP | 1048798 | 11/2000 |
| GB | 2 227 802 A | 8/1990 |
| WO | WO 00/47349 | 8/2000 |

OTHER PUBLICATIONS

"Lenton Anschluβbewehrung" Erico B.V. 1987.
Bar Tec "Splicing System" CCL Systems. (four page brochure) undated.
Lenton® "Anschluβbewehrung" Erico® (seven page brochure) undated.

* cited by examiner

*Primary Examiner*—David P. Bryant
(74) *Attorney, Agent, or Firm*—John W. Renner; Renner, Otto, Boisselle & Sklar

(57) ABSTRACT

A process for forming an improved tensile strength deformed reinforcing bar splice for use in concrete construction by radially compressing or cold forming the bar end with dies literally to flatten any ribs or deformations on the bar end to cold work a section of the bar end which will extend beyond any threaded section and the mouth of a coupler thereon. The splice formed has superior tensile qualities. The process is inexpensive and may be accomplished at or near a construction site.

25 Claims, 6 Drawing Sheets

DEFORMED REINFORCING BAR SPLICE AND METHOD

DISCLOSURE

This invention relates generally to a deformed reinforcing bar splice and method and more particularly to a bar splice and method which will achieve higher tensile strength, bar break (full ultimate) splices with minimal field working, energy, fabrication and cost.

BACKGROUND OF THE INVENTION

Conventional taper thread deformed reinforcing bar couplers have been sold for many years throughout the world under the trademark LENTON®. LENTON® is a registered trademark of ERICO INTERNATIONAL Corporation of Solon, Ohio, U.S.A. Taper threads are preferred because of the ease of assembly requiring only a few turns of the sleeve coupler or bar and the ability to avoid cross threading and subsequent damage to the threads.

The threading process cuts the taper threads in the deformed bar end including the nominal diameter and any projecting ribs or deformations. The process however notches the bar and such couplings will not normally achieve bar break tensile capability.

In order to achieve higher tensile strength bar splices it has been attempted literally to upset the bar end to obtain a larger diameter end section which then receives a tapered or straight thread which has a larger pitch diameter than the nominal diameter of the bar. In the case of tapered threads the average thread diameter is larger than the bar nominal diameter. Such bars can achieve bar break but at a considerable cost in energy and handling. To achieve such upset bar end, the bar end literally has to be forged with substantial axial force or forge hammering. This is complicated by the fact that reinforcing bar, when cut, generally has a bent end caused by shear equipment, and if the bars are of any length or size the handling and conveying problems result in very high cost bar splices to achieve the desired minimal increase in strength.

A published U.K. Patent Application No. 2 227 802A illustrates a tapered thread bar splice having an enlarged or upset tapered threaded end. More importantly this published patent illustrates the sizable machinery including a large ram and clamps required to upset the bar end all prior to threading. The operation is simply not something that can be done easily, locally, or at a construction or fabrication site. Also to be economical the operation requires large volumes of inventory and careful handling and transportation.

Another simplified example of the type of machinery required is seen in U.S. Pat. No. 5,660,594.

Examples of such prior devices involving high cost forging or upsetting are seen in LENTON® continuity sets sold by applicant. The splices involve tapered threads on forged or upset bar ends.

Straight thread couplers on forged or upset bar ends are seen in U.S. Pat. Nos. 4,619,096, 5,158,527, and 5,152,118.

CCL Systems of Leeds, England also markets a BARTEC system where the bar ends have been enlarged and threaded to mate with parallel sleeve threads.

A coupling similar to that of the above U.K. published patent application is shown in Chinese published application 97107856.4.

It has however been discovered that similar tensile benefits can be achieved without the necessity of the costly upsetting or enlargement of the bar end.

SUMMARY OF THE INVENTION

With the present invention, the deformed bar end is strengthened by cold forming prior to threading, and particularly in the area of the thread at the mouth of the coupler. The cold forming process work hardens the bar end and increases the tensile properties at the thread area enough to create a bar splice capable of achieving bar break.

The swaging or cold forming is accomplished solely by radial compression and in the process flattens or deforms any radially projecting ribs or ridges on the bar end. After the radial compression cold forming operation flatten ing the ribs, the bar end section is then formed with tapered or straight threads by cutting or rolling. The cold swaging process also has the advantage of straightening the bar end which may be slightly bent due to shear equipment. The cold formed section is accordingly straightened to facilitate threading.

The radial compression or cold forming also alleviates problems with reinforcing bar ductility and cracking. More importantly the bar is much easier to handle and does not have to be clamped or blocked against axial movement.

In a preferred cold forming die configuration, the dies form a generally cylindrical area and an adjoining tapered area of the bar, the latter receiving the tapered threads while the former extends the cold formed area beyond what will be the coupler mouth. With this preferred form the taper threading requires less material removal if cut and enhanced cold working both throughout the length of the thread and beyond the mouth of the coupler along the bar.

The cold forming operation as well as cutting and threading may be accomplished on site or in a nearby fabrication shop. Heavy and expensive forging or upsetting machinery and related bar handling is not required to achieve improved bar splice performance.

The radial cold forming or compression process is much easier and less expensive to accomplish than axial upsetting yet provides improved splice performance characteristics providing superior strength connections using standard threaded couplers which install easily with hand tools and which will work on any rebar size world wide.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
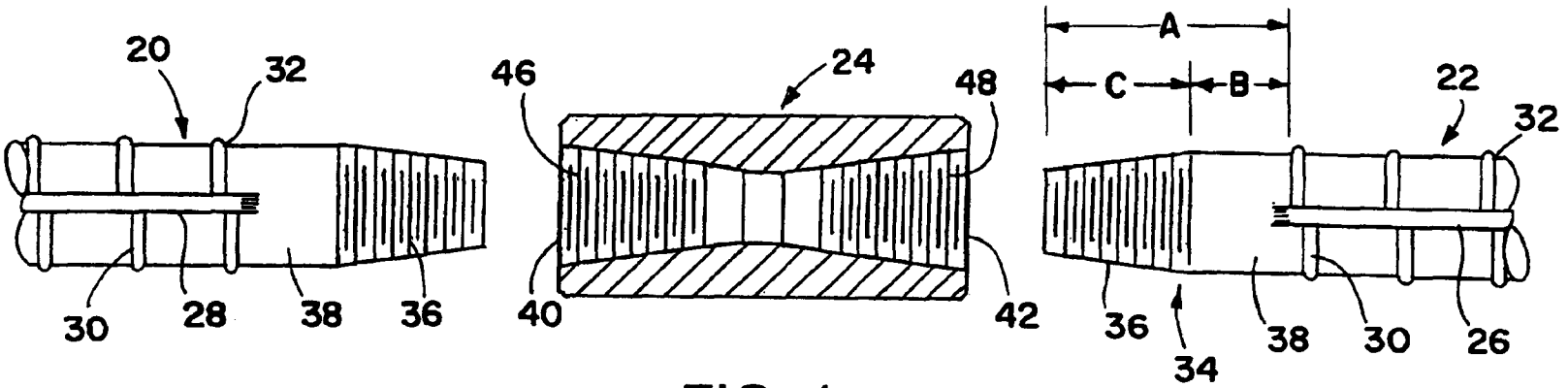
FIG. 1 is an exploded view partially in section of a taper thread deformed bar coupling in accordance with the present invention.

Referring initially to FIG. 1 there is illustrated the components of a taper thread deformed reinforcing bar splice in accordance with the present invention. The splice includes bar 20, bar 22, and the joining internally threaded sleeve 24. While the bars shown are of the same size, they can vary in bar size by use of well known transition couplers with different size threads in each end matching that of the bars. The bar 22 and its threaded end will be described in detail.

Typically, the bar is deformed during the rolling process and is provided with longitudinal diametrically opposite long ribs shown at 26 and 28 on opposite sides of the bar. Included are circumferential ribs 30 somewhat offset from circumferential ribs on the opposite side as shown at 32.

It will be appreciated that commercially available reinforcing bar may be provided with a wide variety of rib or deformation patterns. Such patterns usually include the longitudinal diametrically opposite ribs and circumferential ribs extending either normal to the axis of the bar or at an angle. Some bars are provided with thread form deformations. For more details of the various bar deformations available, reference may be had to various publications of the Concrete Reinforcing Steel Institute (CRSI) of Chicago, Ill., U.S.A. It will also be appreciated that deformed bars of the type illustrated come in various sizes and bar size designations may vary from Number #3 (10 mm) to Number #18 (57 mm), for example, A Number #3 (10 mm) bar may, for example, have a nominal diameter of 0.375" and weigh about 0.376 pounds per foot. On the other hand a Number #18 (57 mm) bar may have a nominal diameter of 2.257" and weigh 13.6 pounds per foot. Needless to say that when bars are of the larger size and substantial length, they become difficult to handle, clamp, and properly support.

The bar 22 has a cold formed insection 34 (A) which includes a threaded tip section 36 (C) and an unthreaded cold formed swaged cylindrical section 38 (B). The capital letters, as illustrated at the right hand side of FIG. 1 refer to the axial length of such sections. It is preferable that the axial length of the swaged section (A) be substantially longer than the length of the threads (C) so that the ends or mouth of the coupler shown at 40 and 42 will be well within the swaged area (A). When the coupler is assembled the mouth 42 will be substantially at the inner end of the thread section (C) and at least the distance (B) extends beyond the mouth of the coupler. The length of the extending swaged section (B) is about one-half of (C) and preferably from about ⅓ to about ⅔ of (C), or more. Stated another way, the extending swaged section (B) is about
⅓ to about ⅔of (A). Preferably, the length of the threads (C) is from about ⅔ to about ½ of (A).

The sleeve 24 may be formed from hex or round stock and has internal threads at each end shown at 46 and 48, matching the tapered threads at 36. The internal tapered threads in the sleeve 24 are slightly longer than the external threads on the tapered bar end but the sleeve may be assembled quickly to the bar ends with relatively few turns and correct torque.

Figure 2:
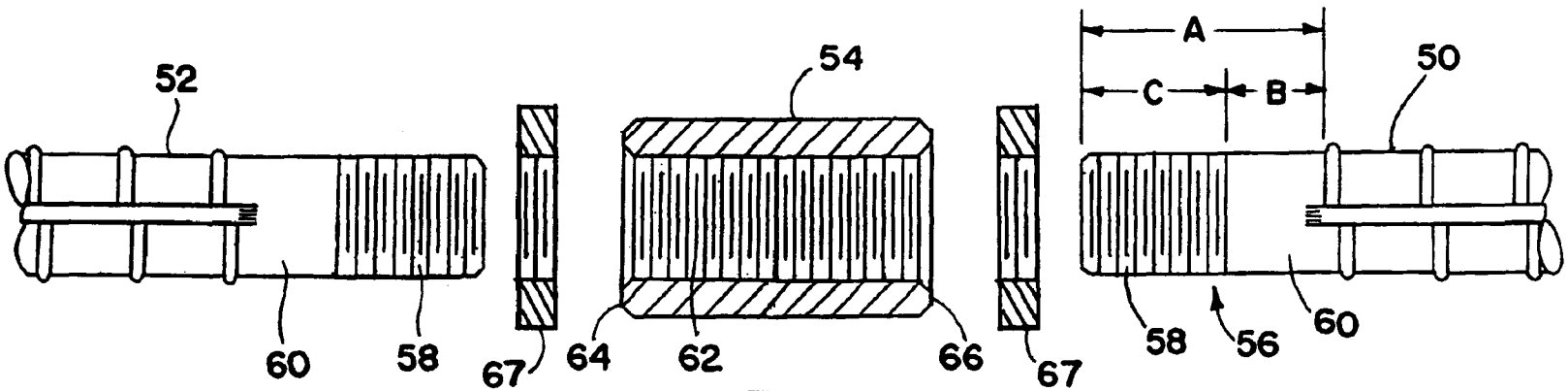
FIG. 2 is a similar view of a straight or parallel thread bar coupling in accordance with the present invention.

A similar splice or coupling is shown in FIG. 2 but instead of taper threads the bar ends and coupling sleeve are provided with straight or parallel threads. As in the tapered thread couplers the bar ends have a section or area which has been cold formed indicated by the dimension (A) shown at 56 which includes the thread length (C) shown at 58 and cylindrical swaged section (B) shown at 60. The sleeve 54 also may be formed from hex or round stock and has a completely threaded internal bore indicated at 62. The sleeve will be threaded on one bar end and the other bar end into the sleeve until the bar ends abut at substantially the midpoint of the sleeve. The sleeves and/or bars are tightened to form the splice. The parallel thread connection shown in FIG. 2 requires much more turning and manipulation of the bars than the taper thread connection seen in FIG. 1. When the bars abut and are tightened, each mouth of the sleeve shown at 64 and 66 will be positioned approximately at the ends of the threads (C) and well within the swaged section (A). Locking rings 67 threaded on the bars may be tightened against the sleeve ends to secure the coupling and reduce any play or slip.

Figure 3:
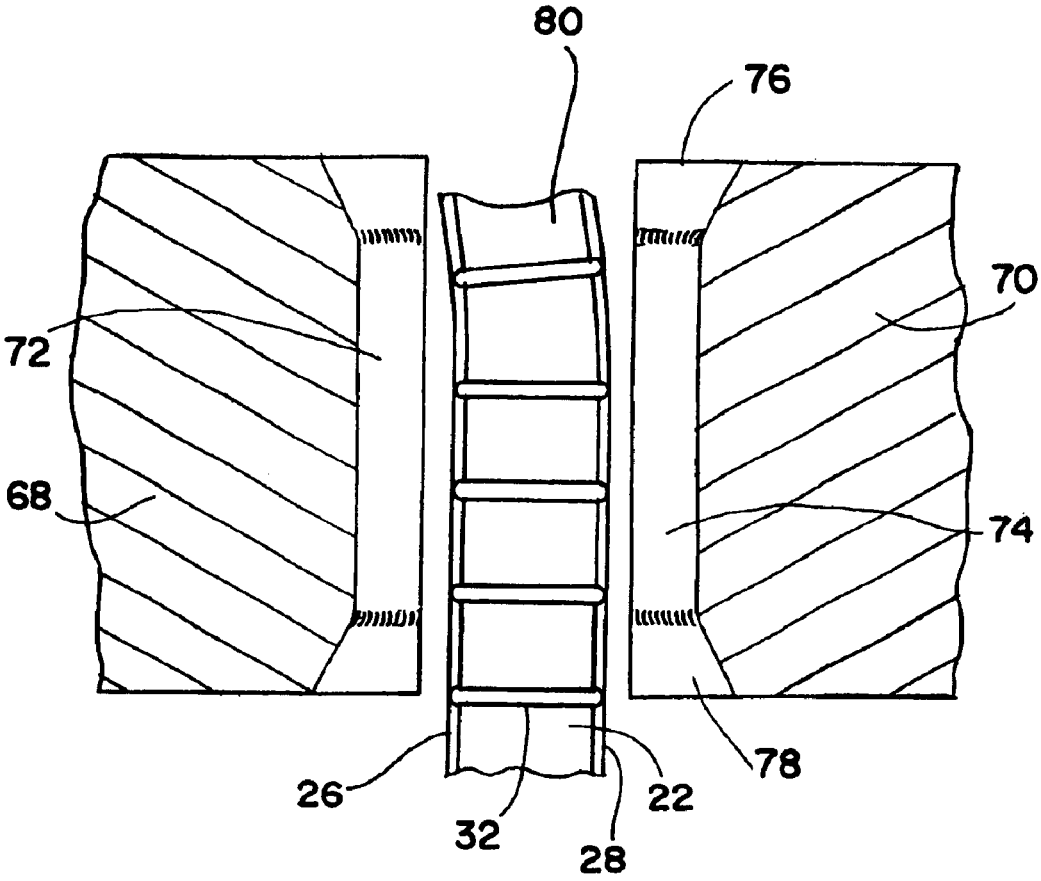
FIG. 3 is a section through open cold forming dies showing a cut deformed bar end prior to forming.
Figure 4:
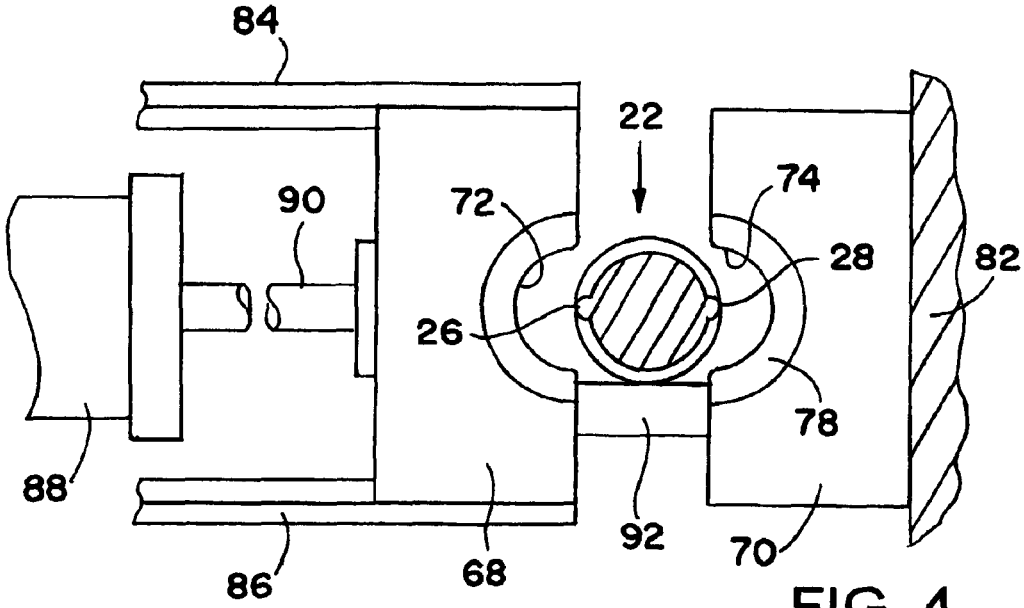
FIG. 4 is an elevation view of the cold forming dies taken normal to the plane of FIG. 3, but with the bar in section.
Figure 5:
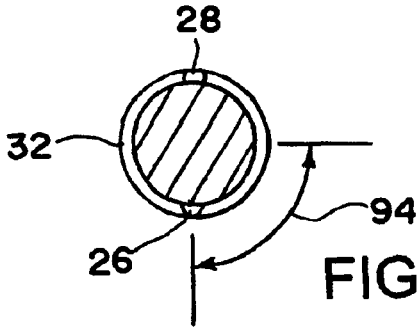
FIG. 5 illustrates the bar being rotated for multiple cold forming operations, if desired.

Referring now to FIGS. 3 through 6, there is illustrated the process of cold forming the bar end to obtain the cold worked section (A) prior to threading. The cold forming process is accomplished by radially compressing the bar 22 between two dies shown at 68 and 70, which includes cylindrical half round cavities shown at 72 and 74, respectively. Each cavity includes a flared end such as seen at 76 and 78 to avoid pressing a sharp corner into the bar. The radius of the cylindrical portion of the cavity is approximately equivalent the nominal diameter of the bar 22. The nominal diameter of the bar is the diameter of the core of the bar not including the projecting deformations such as the ribs 26, 28, or 32. Also, as seen in FIG. 3, when cut by shear equipment, the bar end tends to be slightly bent as shown at 80 and any bent portion of the bar between the dies will be straightened during the compression or cold forming steps.

Figure 6:
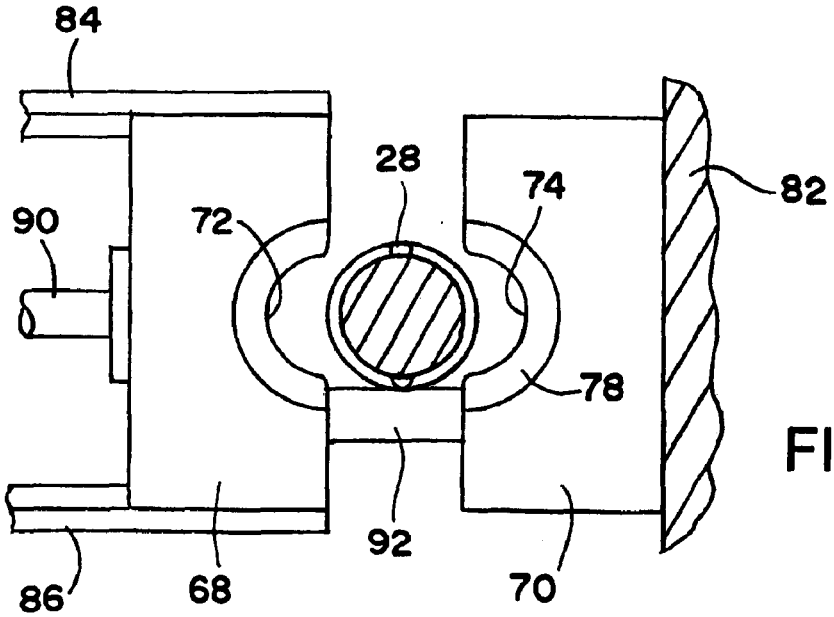
FIG. 6 is a view like FIG. 4 showing the bar being subjected to a typical second forming operation, if desired.

The die 70 may be fixed as indicated at 82, while the die 68 is mounted in slides 84 and 86 and is moved between opened and closed positions by relatively large piston-cylinder assembly 88 connected to the die by rod 90. The bar is supported by several rests or a table indicated at 92 in the proper position for die engagement when the dies are closed. No complex or powerful clamps are required to keep the bar from moving axially, although bar end gauges may be provided simply to position the bar properly from one or the other ends. When the dies are closed the section of the bar between the cylindrical portions of the die cavities will be radially compressed and the force of the dies literally will flatten any projections on the bar end section being compressed. Preferably, the bar end section may be subject to two such compression operations and between such first and second compression operations the bar is rotated about its axis 90 as indicated by the arrow 94 in FIG. 5. After such axial rotation, if desired, the bar end section being formed is subjected to a second compression stroke as indicated in FIG. 6. It may be appreciated that additional compression strokes may be performed on the bar end section being cold formed, but it has been found that one or two are sufficient substantially to flatten or compress any of the projecting ribs or deformations on the bar end section and further compression steps are of minimal cold working value.

Figure 7:
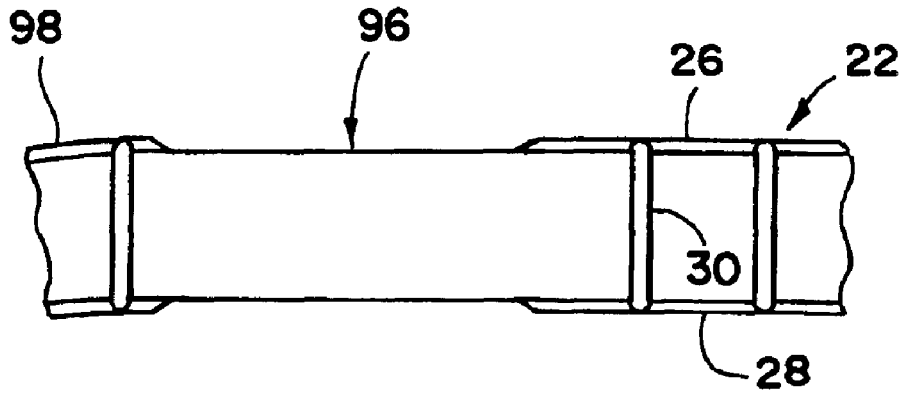
FIG. 7 is a fragmentary side elevation of the bar showing the formed and cold-worked section.
Figure 8:
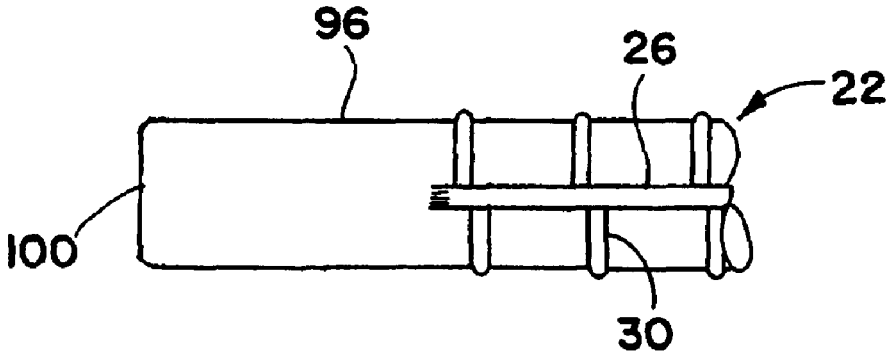
FIG. 8 is a similar view of a bar with full cold formed area ready for bar end threading with either taper or straight threads.

Referring now to FIGS. 7 and 8, it will be seen that the bar 22 cold worked by the dies 68 and 70 now has a section indicated at 96 which has been subjected to the die pressure by radial compression and such radial compression has literally flattened any ribs or projections into the core of the bar and has cold worked the bar end throughout the section 96. If desired, the tip of the bar indicated at 98 extending beyond the formed or compressed section 96 may be cut off leaving a bar end such as seen in FIG. 8 with the cold worked section 96 to receive the threads of either FIG. 1 or FIG. 2. The bar tip 98 may be cut off either prior to or during the threading operation. Tapered or parallel threads may then be formed on the bar end either by cutting or rolling producing a bar end such as seen in FIG. 1 or 2. The length of the threads from the tip 100 will not embrace the entire cold worked or compressed section 96 but rather leave a rather substantial portion so that the cold worked section of the bar end extends well beyond the mouth of the coupler.

Figure 9:
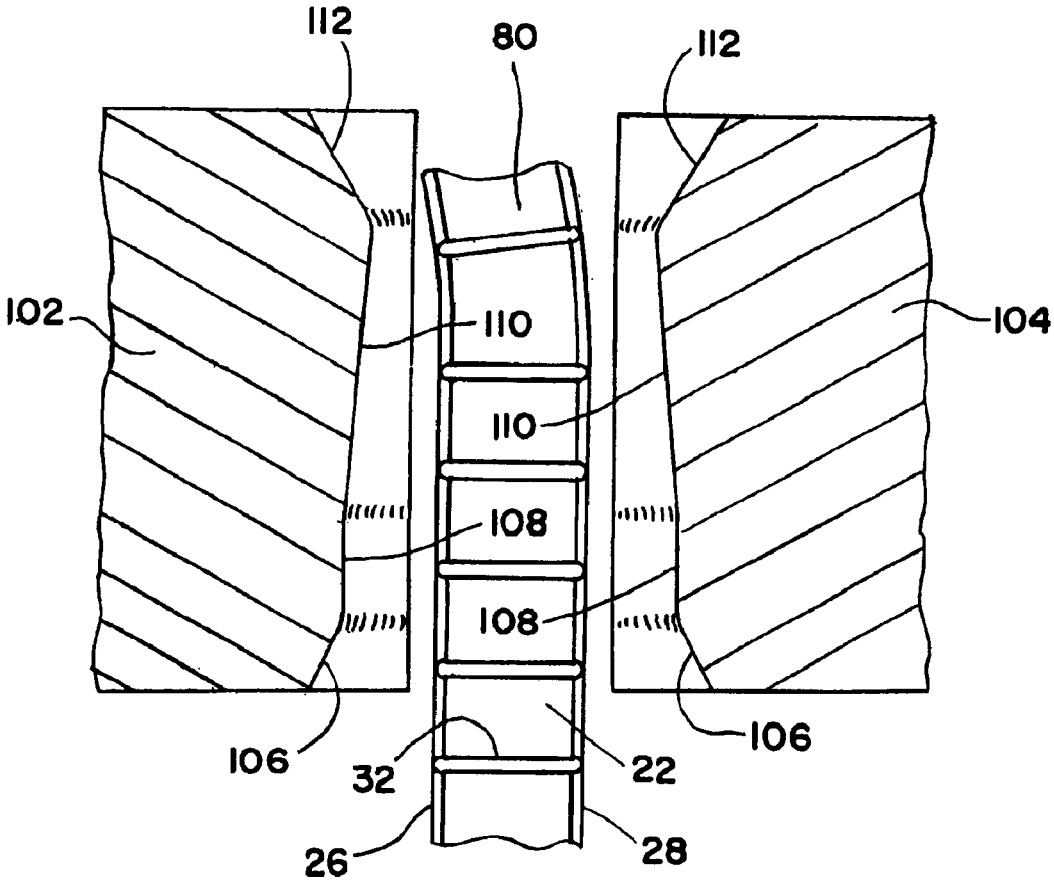
FIG. 9 is a view like FIG. 3 but showing a modified cold forming die configuration which forms a taper on the bar end to facilitate taper threading.
Figure 10:
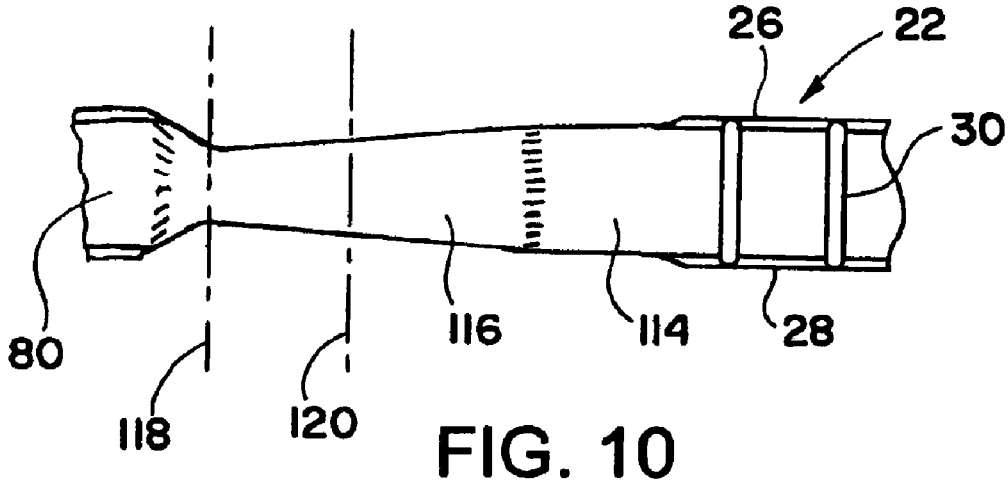
FIG. 10 is a fragmentary elevation of the bar end after cold forming with the dies of FIG. 9 requiring tip removal.

FIG. 9 is a view like FIG. 3 but the dies shown at 102 and 104 have a slightly different configuration. As seen in FIG. 9 each half round die section includes a flared entrance 106, a cylindrical section 108, a somewhat longer tapered section 110 and a flared entrance 112. Subjecting the bar, if desired, to two radial compressions with the bar being rotated 90 between such compressions produces a bar end tapered formed configuration such as shown in FIG. 10. The cylindrical section 108 of the dies produces the cylindrical section 114 on the bar end while the tapered section 110 produces the tapered section 116.

Figure 11:
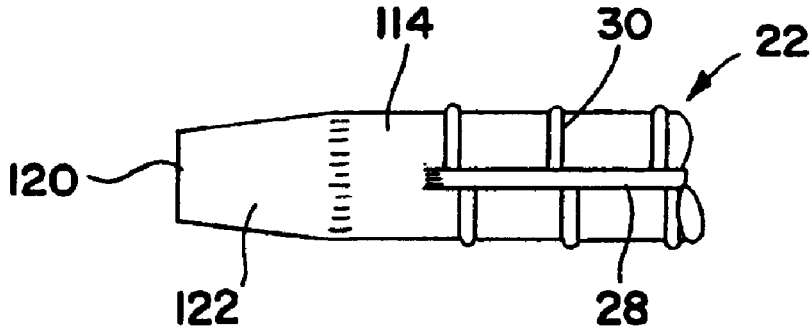
FIG. 11 is a fragmentary view of the bar end of FIG. 10 ready for taper threading to produce the bar end seen in FIG. 1.

The bar end or tip may be cut off as indicated at 118 or 120 depending upon the length of the taper desired. If cut off at 120 this leaves the somewhat shorter tapered cold formed section 122 seen in FIG. 11 which is adjacent to the cylindrical cold formed section 114. The cold worked and tapered section 122 may now be provided with tapered threads either cut or rolled. If cut, the process requires less metal or material to be removed in the thread forming operation. It also facilitates taper thread rolling. Again the cold worked, formed, or radially compressed area of the bar end extends well beyond the tapered section and thus will extend beyond the mouth of the coupler when the splice is completed.

It can now be seen that there is provided a coupling or splice for deformed concrete reinforcing bar which provides an enhanced tensile capability at minimal cost. The bar end is cold formed or radially compressed to improve its strength by cold working literally flattening or compressing the projections in an area of the bar end prior to threading. The length of the cold working of the bar by such radial compression forming is longer than the length of the threads on the bar end so that the mouth of the coupler will be positioned well within the area of forming or cold working.

With the present invention a splice or coupler of superior tensile capabilities can be achieved with minimal field working and cost.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of forming a deformed reinforcing bar splice comprising the steps of cutting a bar to length, cold working the bar end by radially cold forming the bar end at a section of the bar end, then forming a thread on the compressed bar end, with the threads being substantially shorter than the cold formed section, then threading an internally threaded sleeve onto two such formed and threaded bar ends to form a deformed reinforcing bar splice.

2. A method as set forth in claim 1 wherein said threads are tapered and said sleeve has matching internal threads.

3. A method as set forth in claim 2 wherein said cold forming step forms a taper section on said formed section to facilitate threading.

4. A method as set forth in claim 1 wherein said forming step comprises radial compression of the bar flattening any deformations thereon.

5. A method as set forth in claim 4 wherein said bar is radially compressed at least twice with the bar axially rotated between compressions.

6. A method as set forth in claim 5 wherein the bar is radially compressed between dies substantially half round and having a radius approximately that of the nominal diameter of the bar.

7. A method of forming a deformed reinforcing bar splice comprising the steps of cutting a bar to length, cold working the bar end by radially cold forming the bar end at a section of the bar end, then forming a thread on the compressed bar end, with the threads being axially within the cold formed and threaded bar ends to form a deformed reinforcing bar splice, wherein said threads are tapered and said sleeve has matching internal threads, and wherein said formed section extends beyond the tapered threads along the length of the bar.

8. A method as set forth in claim 7 wherein said formed section extends beyond the threads for at least about half the length of the threads.

9. A method of forming a deformed reinforcing bar splice comprising the steps of cutting a bar to length, cold working the bar end by radially cold forming the bar end at a section of the bar end, then forming a thread on the compressed bar end, with the threads being axially within the cold formed section, then threading an internally threaded sleeve onto two such formed and threaded bar ends to form a deformed reinforcing bar splice, wherein said threads are tapered and said sleeve has matching internal threads, said cold forming step forming a taper section on said formed section to facilitate threading, and said cold forming step forms a cylindrical section next to and at the larger end of said taper section; and then forming threads on said taper section.

10. A process for forming a deformed bar end used in concrete construction comprising the steps of cutting the bar end, then radially cold forming the bar end by pressing the bar end to remove the deformations at the bar end and to cold work the bar end while circularizing the bar end, and threading the radially pressed section of the bar end to receive a threaded sleeve coupler, the length of radial cold forming being substantially longer than the threads so that the mouth of the coupler will be positioned on a pressed area of the bar extending beyond the mouth of the coupler.

11. A process as set forth in claim 10 wherein the pressed area of the bar end extending beyond the mouth of the coupler is from about ⅓ to about ⅔ the axial length of the threads.

12. A process as set forth in claim 11 wherein the pressed area of the bar not threaded is from about ⅓ to about ⅔ the total pressed area of the bar.

13. A process as set forth in claim 10 wherein said threads are tapered.

14. A process as set forth in claim 10 wherein said threads are parallel.

15. A process as set forth in claim 10 wherein said cold forming the bar end also straightens the bar end.

16. A process as set forth in claim 10 wherein said cold forming the bar end forms a tapered and adjacent cylindrical cold worked section of the bar end.

17. A process as set forth in claim 16 wherein the adjacent cylindrical section extends from the large end of the taper for about ⅓ to about ⅔ or more the length of the taper.

18. A method of forming a deformed reinforcing bar connection comprising the steps of cutting a bar to length, cold working the bar end by radially compressing and cold forming the bar end, then forming a thread on the compressed bar end, with the threads being axially shorter than the length of the cold formed section, then seating the threaded bar end into the mouth of an internally threaded sleeve to form a deformed reinforcing bar connection.

19. A method asset forth in claim 18 wherein said threads are tapered and said sleeve has matching internal threads.

20. A method as set forth in claim 19 wherein said cold forming step forms a taper section on said cold formed section to facilitate taper threading.

21. A method as set forth in claim 20 wherein said compressed and cold formed bar end section extends beyond the mouth of the sleeve.

22. A method as set forth in claim 21 wherein said compressed and cold formed section extends beyond the threads on the bar end for at least about half the length of the threads.

23. A method as set forth in claim 18 wherein said compressing and cold forming step comprises radial compression of the bar flattening any deformations thereon.

24. A method as set forth in claim 23 wherein said compressing and cold forming step forms a cylindrical section next to and at the larger end of said taper section.

25. A method as set forth in claim 23 wherein said bar is radially compressed at least twice with the bar axially rotated between compressions.

* * * * *

UNITED STATES PATENT AND TRADEMARK OFFICE

CERTIFICATE OF CORRECTION

PATENT NO. : 6,880,224 B2
APPLICATION NO. : 10/603367
DATED : April 19, 2005
INVENTOR(S) : Colarusso et al.

It is certified that error appears in the above-identified patent and that said Letters Patent is hereby corrected as shown below:

Column 6, line 21-22, between the phrases "axially within the cold formed" and "and threaded bar ends", insert --section, then threading an internally threaded sleeve onto two such formed--.

Column 7, line 12, replace "asset" with --as set--.

Signed and Sealed this

Thirteenth Day of November, 2007

JON W. DUDAS
*Director of the United States Patent and Trademark Office*